United States Patent [19]

Yajima

[11] 3,974,810

[45] Aug. 17, 1976

[54] FUEL INJECTION PUMP

[75] Inventor: Kenichi Yajima, Kawagoe, Japan

[73] Assignee: Diesel Kiki Kabushiki Kaisha, Tokyo, Japan

[22] Filed: Apr. 24, 1974

[21] Appl. No.: 463,722

[30] Foreign Application Priority Data

May 1, 1973 Japan ..... 48-50172[U]

[52] U.S. Cl. ..... 123/139 R; 123/139 AE; 239/533; 417/494

[51] Int. Cl.[2] ..... F02M 39/00

[58] Field of Search ..... 123/198 DB, 139 AD, 123/139 AE, 139 AG, 139 AZ, 139 AR, 21, DIG. 7; 239/533; 417/494

[56] References Cited

UNITED STATES PATENTS

| | | | |
|---|---|---|---|
| 1,706,785 | 3/1929 | Junkers | 123/139 AD |
| 2,565,681 | 8/1951 | Fleck et al. | 417/494 |
| 2,890,657 | 6/1959 | May et al. | 417/494 |
| 3,438,327 | 4/1969 | Thompson | 417/494 |
| 3,567,346 | 3/1971 | Meekes et al. | 239/533 |
| 3,741,685 | 6/1973 | Simko | 123/139 AZ |

FOREIGN PATENTS OR APPLICATIONS

| | | | |
|---|---|---|---|
| 1,164,392 | 10/1958 | France | 123/139 AE |
| 499,871 | 5/1930 | Germany | 123/139 AD |
| 50,886 | 1972 | Japan | |
| 59,938 | 10/1944 | Netherlands | 123/139 AE |
| 171,126 | 11/1934 | Switzerland | 123/139 AR |

*Primary Examiner*—Charles J. Myhre
*Assistant Examiner*—Paul Devinsky
*Attorney, Agent, or Firm*—Larson, Taylor & Hinds

[57] ABSTRACT

In a fuel injection pump having two kinds of plungers rotatably displaced by a common rack, each of one kind of plungers ceasing fuel supply and each of the other kind of plungers supplying fuel during idling of an engine, a measuring screw-like groove of each plunger ceasing fuel supply during idling of the engine has a longitudinal groove communicating with a plunger pump chamber. The longitudinal groove is of relatively enlarged width, and a cut portion crossing at a right angle to said longitudinal groove is provided at the intersection of the longitudinal groove and the upper edge of the screw-like groove. The depth of this cut portion increases toward the longitudinal groove.

1 Claim, 3 Drawing Figures

FUEL INJECTION PUMP

The present invention relates to a fuel injection pump for an injection type internal combustion engine, particularly a multicylinder high speed Diesel engine for vehicles.

Recently, Diesel engines for vehicles, have tended to increase their maximum rated speed in order to increase engine output, and as a result a fuel injection system is designed to be suitable for a high speed flow. On the other hand, restrictions for exhaust gases are strengthened and in order to reduce the exhaust gases to the utmost, an accurate and regular combustion is required to be obtained even when the engine is idle. However, it is extremely difficult to supply a small quantity of fuel into each of the engine cylinders accurately and regularly when the engine is idling.

Thus, in known devices as disclosed in the Japanese Pat. Publication No. 50886/72 and the Japanese Pat. No. 154,906, fuel supply is ceased for some of a plurality of cylinders in the engine when it is idle and a greater amount of fuel relative to that previously fed when the engine is idle is supplied to the rest of the cylinders so as to decrease the number of actually-operated cylinders in the engine, so that temperatures of the rest of the actually-operated cylinders are raised by increase in the quantity of fuel, thereby securing a good condition of combustion.

The above described construction is an injection pump of a multi-plunger type having a rack which controls in common the rotational position of each of the plungers and adapted to control the quantity of injected fuel by a metering screw-like groove in the periphery of each plunger, wherein cylinders supplied with fuel when an engine is idle and cylinders ceased in fuel supply have different shapes of metering screw-like grooves in the corresponding plungers, respectively. That is, each of the metering screw-like grooves of the plungers which cease fuel supply, is relatively large in width in a vertical portion which is in communication with the upper edge of the plunger and at a corner portion of the vertical portion and the upper edge of the screw-like portion there is a cut portion formed by cutting off the corner portion with a straight line inclined to both the vertical portion and the upper edge of the screw-like portion. However if the plunger having the metering screw-like groove as described above is incorporated, the quantity of fuel supplied by the slight movement of the rack in the vicinity of the turning point between idle and load conditions is rapidly changed, which brings about disadvantages such as hunting of the engine.

The object of the invention is to overcome the above described disadvantages and to obtain smooth operation of the engine from rotation in its idling state to that at a maximum rate without rapid change in the quantity of the fuel caused by a slight displacement of the rack.

In order that the invention may be more readily understood, reference will now be made, by way of example, to the accompanying drawing in which.

Figure 1:
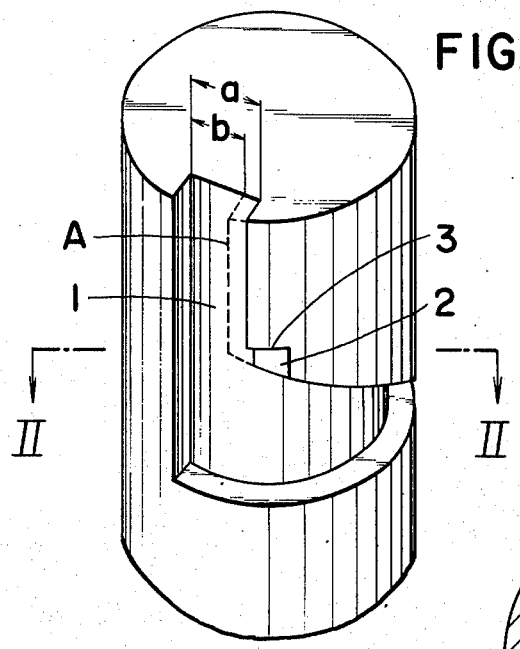
FIG. 1 is a perspective view of a plunger according to the invention.
Figure 2:
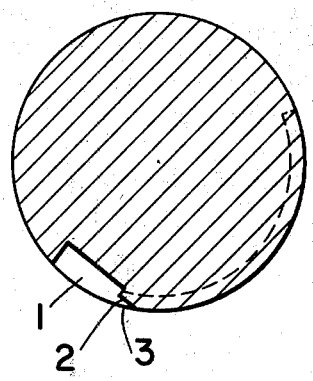
FIG. 2 is a sectional plan view taken along the line II—II of FIG. 1.

Referring now to FIG. 1, the width $a$ of a longitudinal groove 1 in a plunger which is "non-pumping" during idling of the engine is formed greater than the width $b$ of a longitudinal groove of a plunger actually operated when an engine is idling, as indicated by the broken line A. The portion of the width $a - b$ thus cut corresponds to a lead portion at the time of idling. A cut portion 2 formed at the corner intersection with the upper edge of a screw-like groove crosses at a right angle to the longitudinal groove 1, said edge 3 of the cut portion 2 being parallel to the upper edge of the plunger and in a sectional plane taken along the line II—II of FIG. 1. As shown in FIG. 2, depth of the cut portion becomes deeper toward the longitudinal groove 1.

Figure 3:
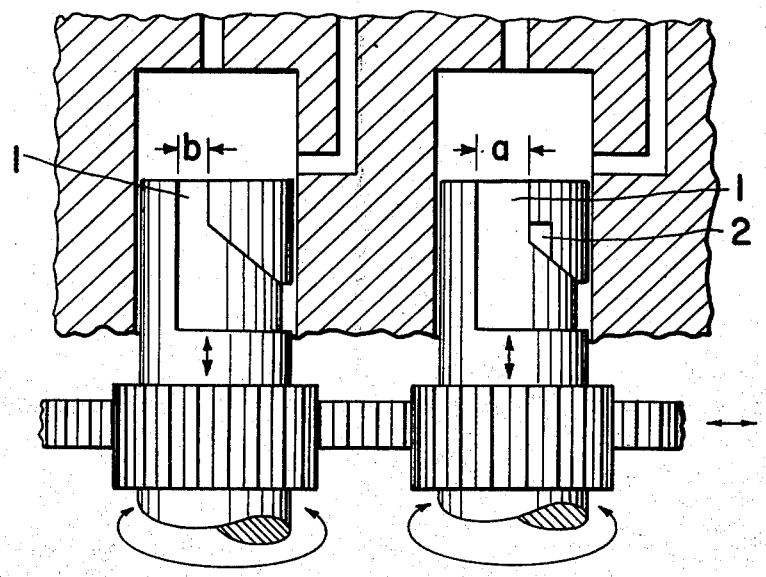
FIG. 3 is a schematic sectional view showing plungers of the two types, conventionally rotatably joined by a common rack.

FIG. 3 shows the two types of plungers as conventionally rotatably interconnected in a pump body, which may be considered as conventional apart from the novel plunger. Since the pump details form no part of the invention as such, they have not been shown, or have been indicated only schematically.

The operation of the fuel delivering through the action of plunger provided with a metering screw-like groove as constructed above will now be described.

In a position where a rack FIG. 3 is moved in the fuel decreasing direction and where a discharge port of a plunger barrel FIG. 3 is begun to be aligned with the cut portion 2, when communicated with the upper edge 3 of the cut portion 2, the fuel begins to escape from the discharge port. However, in this position, the depth in the cut portion 2 is so shallow that less fuel escapes. Further, in a position where the plunger is moved by the rack and where the longitudinal groove 1 is close to the discharge port, the depth in the cut 2 is so deep that much fuel escapes. That is to say, the depth of the cut portion 2 deepens depending upon the arc in the outer periphery of the plunger so that the fuel increasingly escapes in quantity in proportion thereto.

From the above, it will be appreciated that smooth operation of the engine may be obtained from rotation in its idling state to that at a maximum rate without rapid change in the quantity of the fuel caused by a slight displacement of the rack as mentioned above.

What is claimed is:

1. In a fuel injection pump of the type having two sets of plungers commonly rotatably displaceable and having metering grooves for cooperating with a pump port such that the plungers of one set cease supplying fuel to their associated engine cylinders during idling of an engine, whereas the plungers of the other set supply fuel to their associated cylinders during idling of the engine, the plungers of each set having a generally helical metering groove formed in the cylindrical surfaces thereof, and a longitudinal groove in the cylindrical surface communicating said metering groove with the upper end of the plunger and hence with the pump chamber of the plunger, the longitudinal grooves in the plungers of said one set being relatively enlarged in width relative to the longitudinal grooves of the plungers of said other set such that rotation of the plungers brings the longitudinal groove of each plunger of said one set into a non-pumping relationship with its pump port when the plungers of said other set are in their engine-idling fuel delivery positions, and a cut recess at the intersection of the longitudinal groove and the helical groove of each plunger of said first set, each said cut recess extending at a right angle to its longitudinal groove between the cylindrical surface of its plunger and the opening of the recess into its longitudinal groove, the upper end of each said recess being closed, the lower end opening into said helical groove and the floor of each recess being oriented such that the depth of the recess increases toward the longitudinal groove.

* * * * *